United States Patent [19]

Kaneda et al.

[11] Patent Number: 4,526,239

[45] Date of Patent: Jul. 2, 1985

[54] UNDERWATER HYDRAULIC TOOL

[75] Inventors: Hidehiko Kaneda, Ibaraki; Natsuo Inagaki; Hitoshi Yamaguchi, both of Yokohama, all of Japan

[73] Assignee: Japan Marine Science & Technology Center, Yokosuka, Japan

[21] Appl. No.: 484,234

[22] Filed: Apr. 12, 1983

[30] Foreign Application Priority Data

Apr. 12, 1982 [JP] Japan ..... 57-51815[U]

[51] Int. Cl.[3] ..... B25D 17/14

[52] U.S. Cl. ..... 173/73; 173/171; 173/69; 173/168; 173/DIG. 1; 51/356

[58] Field of Search ..... 173/DIG. 1, DIG. 3, 173/171, 62, 69, 72, 73, 168, 169; 60/912; 51/356

[56] References Cited

U.S. PATENT DOCUMENTS 3,376,673 4/1968 Metzger et al. ..... 51/356
3,468,385 9/1969 Penza ..... 173/DIG. 1

FOREIGN PATENT DOCUMENTS 707812 4/1954 United Kingdom .
1533440 11/1978 United Kingdom .

*Primary Examiner*—E. R. Kazenske
*Assistant Examiner*—Willmon Fridie, Jr.
*Attorney, Agent, or Firm*—Wenderoth, Lind & Ponack

[57] ABSTRACT

An underwater hydraulic tool has a hydraulic motor with an inlet port and an outlet port for receiving and discharging water under pressure and a rotating shaft rotated by water under pressure with the front end protruding from said motor for holding a working tool. A rear mounting member is attached to a rear part of the hydraulic motor and has openings spaced circumferentially therearound. A front mounting member is attached to a front part of the hydraulic motor and also openings spaced circumferentially therearound. At least portions of the openings in both members are located outwards of the outer circumferential wall of the hydraulic motor. The mounting members support the hydraulic motor in a hollow space in a housing with the front end of the rotating shaft protruding forward of the housing, the rear mounting member having the periphery thereof engaged with the inner wall of said housing defining the space and the front mounting member being fixed to the housing at the opening of the hollow space with at least portions of the openings in the front mounting member being inwards of the inner wall of the housing. The exterior of the hydraulic motor is spaced from the inner wall of the housing to leave a gap therebetween through which the water under pressure discharged from the outlet port flows along the hydraulic motor through the openings in the rear and front mounting members and past the front end of the shaft.

8 Claims, 7 Drawing Figures

UNDERWATER HYDRAULIC TOOL

TECHNICAL FIELD

The present invention relates to an underwater hydraulic tool which uses a miniature light weight hydraulic motor and which can easily be operated under water by a diver.

BACKGROUND AND PRIOR ART

Conventional underwater tools are under water pneumatic tools, underwater hydraulic oil tools and underwater electrically-driven tools which respectively utilize air pressure, oil pressure and an electric power source for driving them. Such conventional underwater tools have certain disadvantages.

In the underwater pneumatic tools, the air is usually exhausted into the surrounding water so that the depth at which the underwater pneumatic tool can be used is limited due to backpressure on the discharged air. Moreover, large quantities of bubbles are generated so that visibility in the water is disturbed and in some cases, the use of acoustic communication through the water is disturbed.

In the underwater oil-hydraulic tools, two hoses must be connected between the hydraulic oil tool and a hydraulic oil supply to circulate the oil, so that the structure is complicated and the operation is troublesome, and moreover the water can be contaminated due to oil leakage resulting from damage to the hoses.

In underwater electrically-driven tools, electrical leakage into the water can occur so that it is dangerous for the diver to operate the underwater electrically-driven tool.

In order to eliminate such defects, an underwater hydraulic tool which uses a miniature and light weight hydraulic motor utilizing water under pressure as the power source has been devised, said hydraulic motor being rotated by introducing the water under pressure thereinto from a hose, said water under pressure being produced by sucking in water from a surrounding body of water by any suitable pump disposed on a working ship or the ground etc. and placing it under pressure, and discharging the pressurized water after rotating said hydraulic motor into the surrounding body of water.

When using such an underwater hydraulic tool having the miniature and light weight hydraulic motor, seizure of the rotating shaft of said hydraulic motor may occur due to overheating of rotating-sliding parts of said hydraulic motor.

SUMMARY OF THE INVENTION

The present invention has as its object the elimination of such defects. This is accomplished by cooling the rotating-sliding parts of the hydraulic motor by utilizing the water discharged from the hydraulic motor, whereby malfunctioning due to overheating of the rotating-sliding parts is eliminated.

To this end, the present invention provides an underwater hydraulic tool comprising:

a hydraulic motor having an inlet port and an outlet port for receiving and discharging water under pressure and a rotating shaft rotated by water under pressure, said rotating shaft having a front end protruding from said motor for holding a working tool member thereon;

valve means connected to said inlet port;

a rear mounting member attached to a rear part of said hydraulic motor, said rear mounting member having openings spaced circumferentially therearound, at least portions of said openings being located outwards of the outer circumferential wall of said hydraulic motor;

a front mounting member attached to a front part of said hydraulic motor, said front mounting member having openings spaced circumferentially therearound, at least portions of said openings being located outwards of said outer circumferential wall of said hydraulic motor; and a housing made of a buoyant material which is resistant to pressure, said housing having a hollow space therein opening out of the front end thereof, said hydraulic motor being positioned in said space with said front end of said rotating shaft protruding forward of said housing, said rear mounting member having the periphery thereof engaged with the inner wall of said housing defining said space and said front mounting member being fixed to said housing at said opening of said hollow space, at least portions of said openings in said front mounting member being inwards of the inner wall of said housing, said rear and front mounting members supporting said hydraulic motor in said space with the exterior of said hydraulic motor spaced from the inner wall of said housing to leave a gap therebetween through which the water under pressure discharged from said outlet port flows along said hydraulic motor through the openings in said rear and front mounting members and past the front end of said shaft.

The advantages of the underwater hydraulic tool according to the present invention are (1) Because no air is used, the visibility in the water in the vicinity of the tool is improved.

(2) It is very easy to obtain the water as driving medium.

(3) Only a single hose need be connected between the underwater hydraulic tool and the pump.

(4) The underwater hydraulic tool can be used at any depth.

BRIEF DESCRIPTION OF THE DRAWINGS

The invention will now be described in greater detail in connection with the accompanying drawings, in which.

DESCRIPTION OF THE PREFERRED EMBODIMENTS

Figure 1:
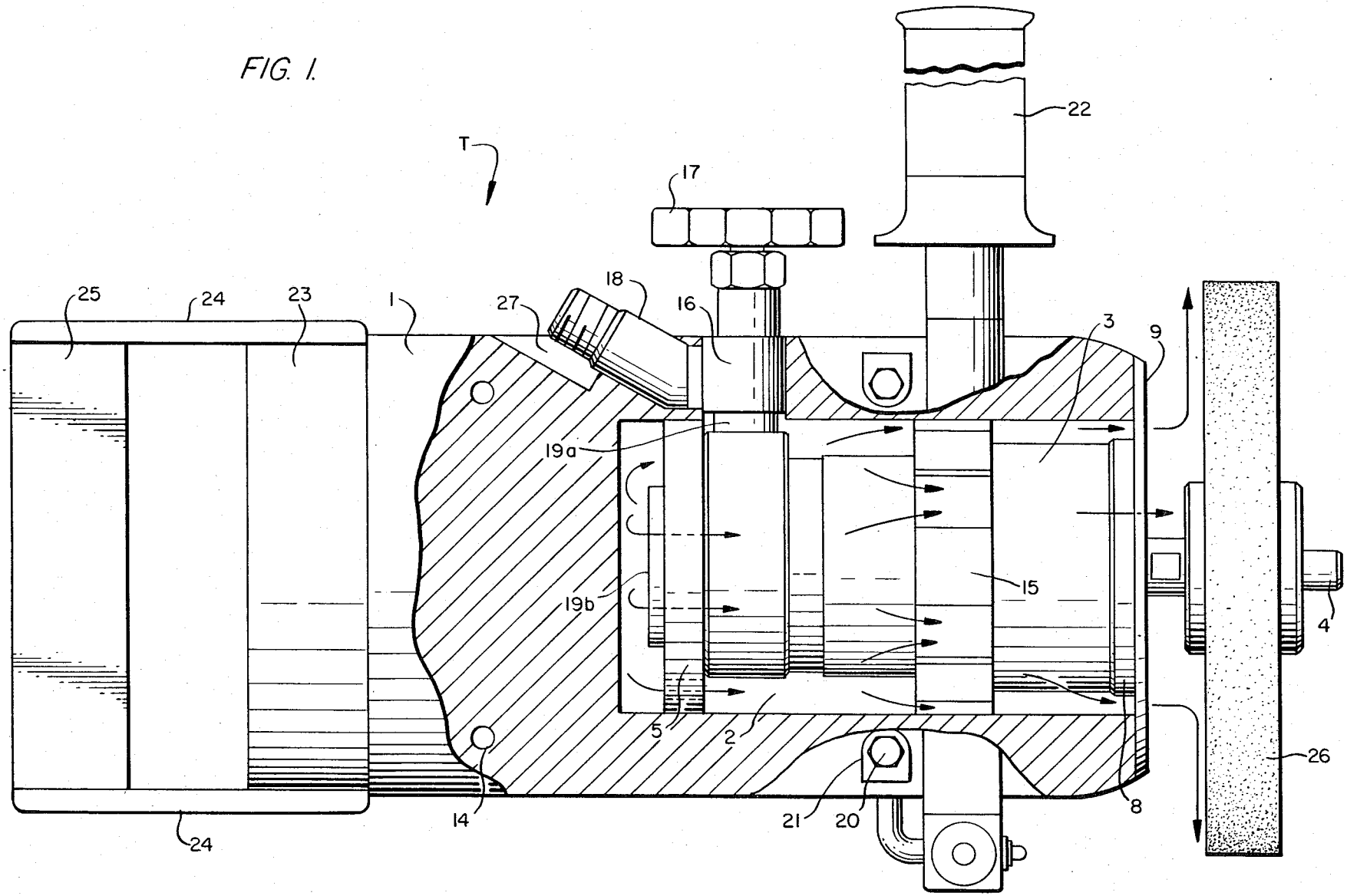
FIG. 1 is a side view of the underwater hydraulic tool according to the present invention with a part of a housing cut out.

The underwater hydraulic tool T according to the invention is shown in FIG. 1 and comprises a housing 1 which is provided with a cylindrical space 2 therein having an open end opening out of the front of said housing. A hydraulic motor is positioned in the cylindrical space 2. Preferably, an underwater hydraulic motor as described in U.S. patent application of Kenji Sugino and Yukiaki Nagata, Ser. No. 338,061, filed on Jan. 8, 1982 is used as the hydraulic motor, but any suitable hydraulic motor may be used. The hydraulic motor in the shown embodiment is a nozzle-runner-turbine-motor having a motor casing 3 with an inlet port 19*a* and an outlet port 19*b* for the water under pressure and a rotating shaft 4 to which a runner (not shown) is attached. The forward end of the rotating shaft 4 protrudes forwards from a front end 8 of the hydraulic motor casing 3. Any suitable working tool can be attached to the front end. It is advantageous that the outlet port 19*b* is located at the rear end of the hydraulic motor casing 3, but the output port 19 need not necessarily be located at the rear end of the hydraulic motor casing 3.

Figure 2:
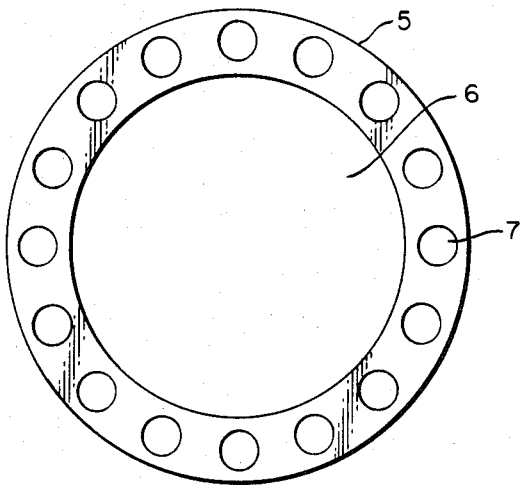
FIG. 2 is an enlarged front view of a rear mounting member.
Figure 3:
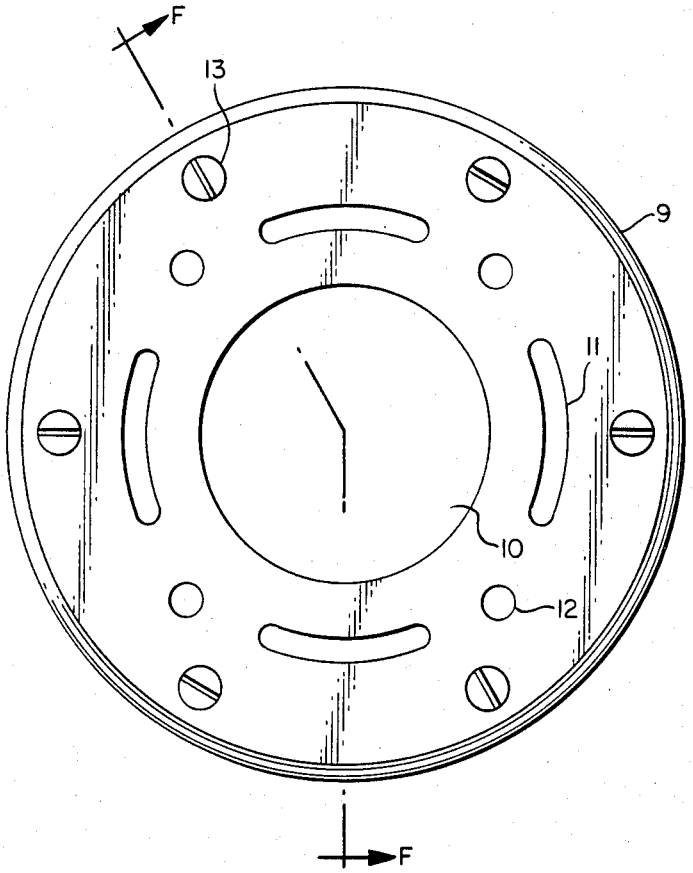
FIG. 3 is an enlarged front view of a front mounting member with counter-sunk mounting screws fitted thereinto.
Figure 4:
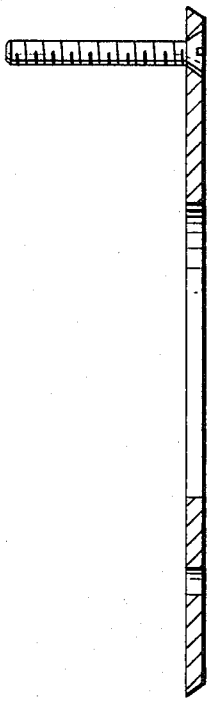
FIG. 4 is a transverse section taken along the line F—F in FIG. 3.
Figure 5:
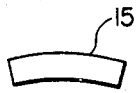
FIGS. 5 and 6 are enlarged front view and an enlarged plan view of an intermediate mounting member, respectively.
Figure 6:
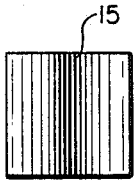

A rear mounting member 5 as shown in FIG. 2 is fitted onto a rear part of the hydraulic motor 3, the motor being in a central hole 6 in the member 5. The annular part of the rear retaining member 5 is provided with a plurality of circular openings 7. As described hereinafter, the water passing through the circular openings 7 can flow along the outer circumferential wall of the hydraulic motor casing 3. A front mounting member 9 as shown in FIG. 3 is fitted onto a front part of the hydraulic motor casing 3, the motor casing being in a central hole 10 in the member 9. The annular part of the front mounting member 9 is provided with a plurality of arcuate openings 11. If desired, a plurality of bolt holes 12 may be formed in the annular part to attach the front mounting member 9 to the front part of the hydraulic motor casing 3 by means of screws or bolts 13. The shaft 4 protrudes through the central hole 10. Similarly, the annular part of the rear mounting member 5 may be provided with a plurality of bolt apertures (not shown) to attach the rear mounting member 5 to the rear end of the hydraulic motor casing 3 by means of bolts (not shown) so as to leave the central hole 6 for passage of the water discharged from the hydraulic motor casing 3. Alternatively the front mounting member 9 can be mounted on a lug (not shown) on the front end of the housing 1 by means of the counter-sunk screws 13, any suitable bolts or adhesives. Thus, the hydraulic motor 3 is supported in the space 2 by the rear mounting member 5 and the front mounting member 9. When the outlet port 19*b* is in the rear of the motor casing 3, the rear of the motor casing 3 should be spaced forwardly from the inner end of the space 2. If desired, a plurality of arcuate intermediate mounting members 15, for example, six intermediate mounting members, may be arranged around the outer circumferential wall of an intermediate part of the hydraulic motor casing 3 or around the corresponding inner circumferential wall of the cylindrical space 2 to support a central part of the hydraulic motor casing 3.

When the rear mounting member 5 and the front mounting member 9 are attached to the hydraulic motor casing 3, at least portions of the openings 7 and 11 are located outwards of the outer circumferential wall of the hydraulic motor casing 3. Moreover, when the front mounting member 9 is fixed to the front end of the housing 1, at least portions of the openings 11 are located inward of the inner circumferential wall of the cylindrical space 2. Where the outlet port 19*b* is located at the rear end of the motor casing 3, discharged water will flow outwardly and then forwardly along the outer circumferential wall of motor casing 3 through openings 7 and 11. If the outlet port 19*b* is located forward of the rear mounting member 5, it is clear that a portion of the water discharged from the outlet port 19*b* will flow rearwards through the openings 7 and again flow frontwards through the openings 7.

Preferably, the housing comprises two semi-cylindrical parts each of which has a semi-cylindrical space, and the parts are assembled by inserting bolts through bolt holes 14 formed in the semi-cylindrical parts, placing nuts on the bolts and tightening the nuts. Preferably the housing is made of buoyant material resistant to pressure, such as syntactic foam sold by Emerson & Cuming, Inc. under the trade designation Eccofloat to facilitate operation by the diver under water.

Figure 7:
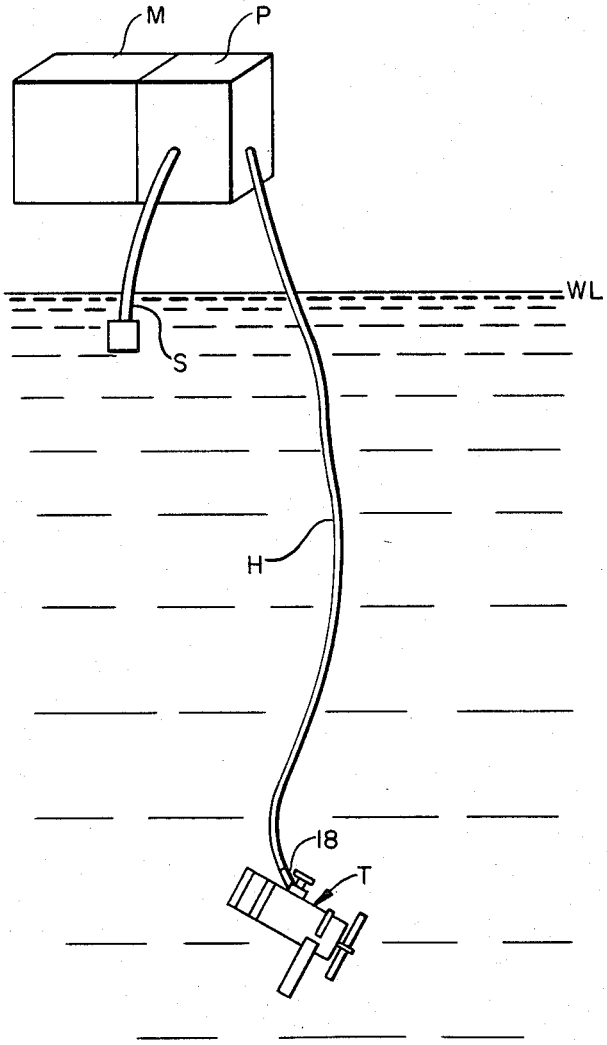
FIG. 7 is a schematic view of a system wherein the underwater hydraulic tool is used.

A valve housing 16 having therein a valve for controlling the flow of the water under pressure is connected to the inlet port 19*a* of the hydraulic motor casing 3, and a handle 17 is connected to the valve for operating the valve. As shown in FIG. 7, a water-conveying hose H is attached to a fitting 18 on the valve housing 16.

The valve housing 16 is positioned in a recess 27 defined by opposed notches in the two semi-cylindrical parts constituting the housing 1.

In the assembly of the underwater tool T, the hydraulic motor casing 3 to which the valve housing 16 and the rear mounting member 5 has been attached is mounted in the semi-cylindrical space and the notch of one of the semi-cylindrical parts constituting the housing 1 and the other of the semi-cylindrical parts is placed over the hydraulic motor casing 3 and against the one semi-cylindrical part. Then, the two semi-cylindrical parts are fastened together by means of bolts and nuts and then the front mounting member 9 is attached to the front end of the assembled housing 1 by means of the countersunk screws 13, or bolts or adhesives, whereby the hydraulic motor is positioned in the cylindrical space 2 as shown in FIG. 1.

The front part of the housing 1 is provided with, for example, two bolt holes similar to the bolt holes 14 and bolt heads 20 of bolts inserted into these bolt holes are seated on flats 21 on the outer circumferential wall of one of the semi-cylindrical parts. Similarly, flats are provided on the outer circumferential wall of the other of the semi-cylindrical parts, and nuts threaded onto the ends of the bolts extending through the semi-cylindrical parts are seated on these flats on the other of the semi-cylindrical parts so that two semi-cyindrical members can be further secured to each other.

A front grip member 22 is movably mounted on the housing 1 in the vicinity of the front end thereof. A ring 23 is rotatably mounted on the housing 1 at the rear end thereof. A pair of elongated arms 24 are attached to the ring 23 and a grip rod 25 is attached to the arms 24. A rear grip member is thus constituted by the ring 23, the arms 24 and the grip rod 25. Preferably, the housing 1 is provided with both the front grip member and the rear grip member. It is clear, however, that a single grip member or three grip members or more may be mounted on the housing 1 at any suitable positions.

Any suitable working tool member, for example, a grinding wheel 26 is attached to the front end of the rotating shaft 4.

Referring to FIG. 7, a water-conveying hose H is attached to the fitting 18 and the water under pressure from a pump P disposed on a working ship or the ground is fed to the hydraulic motor through the water-conveying hose H. The water under pressure fed to the hydraulic motor drives the runner to rotate the rotating shaft 4, and then, is discharged from the outlet port 19*b* into the cylindrical space 2. The pump P is driven by suitable prime mover M and sucks in water adjacent to the water surface WL through a suction pipe S.

The operation of the underwater hydraulic tool according to the present invention is as follows.

The prime mover M on the working ship or the ground is driven to operate the pump P. The diver operates the handle 17 to open the valve in the valve housing 16 so that water under pressure from the pump P is fed to the hydraulic motor to rotate the rotating shaft 4. Thereafter, this water is discharged from the outlet port 19*b* into the cylindrical space 2. As shown by the arrows in FIG. 1, the water discharged from the outlet port 19*b* flows through the openings 7 in the rear mounting member 5 and the space between the outer circumferential wall of the hydraulic motor casing 3 and the inner circumferential wall of the cylindrical space 2. If the intermediate mounting members 15 are provided, the discharged water flows through the gaps between the intermediate mounting members 15. Finally, the discharged water flows through the arcuate openings 11 in the front mounting member 9 and is discharged from the cylindrical space 2. Heat generated due to rotation of the rotating shaft 4 within the hydraulic motor is taken up by the water discharged from the hydraulic motor which thus flows along the outer circumferential wall of the hydraulic motor casing 3, whereby the hydraulic motor is effectively cooled.

Moreover, the water discharged through the arcuate openings 11 in the front mounting member 9 flows in the direction shown by the arrows to remove dust etc. produced by the tool member, for example, the grinding wheel 26, whereby the visibility in water around the tool is improved.

Furthermore, since the underwater hydraulic tool according to the present invention is used in water, the water used as the driving medium can easily be obtained and only a single hose need be connected between the hydraulic tool and the pump. The underwater hydraulic tool can be used at any depth simply by increasing the pump pressure.

The angle of inclination of the fitting 18 to the axis of the housing 1 is preferably about 30°, because at this angle the diver can most easily operate the underwater hydraulic tool with the water-conveying hose H attached to the fitting 18. Any other suitable angle of inclination, however, may be adopted.

Alternatively the housing 1 may be made of stainless steel aluminum alloy, wood, FRP (fiber reinforced plastics), epoxy resin or polycarbonate, and in which a suitable sealed space or spaces, other than the cylindrical space 2, is formed to produce buoyancy.

The housing 1 described above comprises two semi-cylindrical parts, but the housing 1 may be a single molded member having the cylindrical space 2 and a space for receiving the valve housing 16 along with the fitting 18. The hydraulic motor is inserted into the cylindrical space 2 and thereafter the valve housing 16 is attached to the hydraulic motor 3.

Referring to FIGS. 2 and 3, the circular openings 7, the arcuate openings 11 and the bolt holes 12 are regularly arranged, but the shapes and the arrangements of these openings and holes may naturally be selected freely.

Finally, the shapes of the housing 1 and the cylindrical space 2 can be any suitable shapes other than cylindrical. In such case, the shapes of the front mounting member 9, the intermediate mounting members 15 and the rear mounting member 5 should be changed correspondingly.

What is claimed is:

1. An underwater hydraulic tool comprising:

a hydraulic motor having a motor casing with an inlet port and an outlet port therein for receiving and discharging water under pressure and a rotating shaft mounted in said motor casing rotated by water under pressure, said rotating shaft having a front end protruding from said motor casing for holding a working tool member thereon;

valve means connected to said inlet port;

a rear mounting member attached to a rear part of said hydraulic motor casing, said rear mounting member having openings spaced circumferentially therearound, at least portions of said openings being located outwards of the outer circumferential wall of said hydraulic motor casing;

a front mounting member attached to a front part of said hydraulic motor casing, said front mounting member having openings spaced circumferentially therearound, at least portions of said openings being located outwards of said outer circumferential wall of said hydraulic motor casing; and a housing made of a bouyant material which is resistant to pressure, said housing having a hollow space therein opening out of the front end thereof, said hydraulic motor being positioned in said space with said front end of said rotating shaft protruding forward of said housing, said rear mounting member having the periphery thereof engaged with the inner wall of said housing defining said space and said front mounting member being fixed to said housing at said opening of said hollow space, at least portions of said openings in said front mounting member being inwards of the inner wall of said housing, said rear and front mounting members supporting said hydraulic motor casing in said space with the exterior of said hydraulic motor casing spaced from the inner walls of said housing to leave a gap therebetween, said outlet port opening out of said motor casing into said gap, whereby the water under pressure discharged from said outlet port flows along said hydraulic motor casing through the openings in said rear and front mounting members and past the front end of said shaft.

2. An underwater hydraulic tool as claimed in claim 1 in which said front mounting member is fixed to the front end of said housing around said opening of said hollow space.

3. An underwater hydraulic tool as claimed in claim 1 in which said valve means comprises a valve housing attached to said hydraulic motor and having a valve outlet connected to said inlet port, said valve housing having a fitting for a water conveying hose for feeding water under pressure, a valve in said valve housing for controlling the flow of the water under pressure fed to said inlet port, and a handle connected to said valve.

4. An underwater hydraulic tool as claimed in claim 1 wherein said buoyant material is syntactic foam.

5. An underwater hydraulic tool as claimed in claim 1 in which said housing comprises two semi-cylindrical parts each of which has a semi-cylindrical space therein opposed to the semi-cylindrical hollow space in the other.

6. An underwater hydraulic tool as claimed in claim 1 in which said front and rear mounting members are ring-shaped members having central holes, and said hydraulic motor casing has a cylindrical outer wall fitted into said central holes.

7. An underwater hydraulic tool as claimed in claim 1 in which said outlet port is in the rear end of said hydraulic motor casing and said rear end is spaced from the inner end of said hollow space, whereby the discharged water flows outwardly of said hydraulic motor and then forwardly along said hydraulic motor casing.

8. An underwater hydraulic tool as claimed in claim 1 further comprising intermediate mounting members around said hydraulic motor casing intermediate said front and rear mounting members, said intermediate mounting members being spaced circumferentially around said hydraulic motor casing with spaces therebetween for flow of discharged water.

* * * * *